US009573044B2

(12) United States Patent
Yi

(10) Patent No.: US 9,573,044 B2
(45) Date of Patent: Feb. 21, 2017

(54) MULTI-FUNCTION BLOCK AND SNOW SLIDING APPARATUS COMPRISING SAME

(71) Applicant: Ji Ha Yi, Seoul (KR)

(72) Inventor: Ji Ha Yi, Seoul (KR)

( * ) Notice: Subject to any disclaimer, the term of this patent is extended or adjusted under 35 U.S.C. 154(b) by 0 days.

(21) Appl. No.: 14/760,497

(22) PCT Filed: Jan. 13, 2014

(86) PCT No.: PCT/KR2014/000344
§ 371 (c)(1),
(2) Date: Oct. 26, 2015

(87) PCT Pub. No.: WO2014/109611
PCT Pub. Date: Jul. 17, 2014

(65) Prior Publication Data

US 2016/0051885 A1 Feb. 25, 2016

(30) Foreign Application Priority Data

Jan. 13, 2013 (KR) ..... 10-2013-0003712

(51) Int. Cl.

| | |
|---|---|
| ***A63C 11/26*** | (2006.01) |
| ***A63C 5/02*** | (2006.01) |
| ***A63C 9/00*** | (2012.01) |
| ***A63C 11/00*** | (2006.01) |
| *A63C 10/00* | (2012.01) |

(52) U.S. Cl.
CPC ..... *A63C 11/26* (2013.01); *A63C 5/02* (2013.01); *A63C 9/003* (2013.01); *A63C 9/005* (2013.01); *A63C 11/003* (2013.01); *A63C 10/00* (2013.01); *A63C 2009/008* (2013.01)

(58) Field of Classification Search
CPC ..... A63C 11/26; A63C 7/02; A63C 7/04; A63C 7/06; A63C 5/003
See application file for complete search history.

(56) References Cited

U.S. PATENT DOCUMENTS

2002/0135157 A1* 9/2002 Kruajitch ..... A63C 9/003 280/607

FOREIGN PATENT DOCUMENTS

| | | | |
|---|---|---|---|
| EP | 0410290 | A1 | 1/1991 |
| KR | 20-0342338 | Y1 | 2/2004 |
| KR | 10-2011-0091881 | A | 8/2011 |
| KR | 10-1174248 | B1 | 8/2012 |

OTHER PUBLICATIONS

International Search Report for PCT/KR2014/000344 mailed May 30, 2014 from Korean Intellectual Property Office.

* cited by examiner

*Primary Examiner* — Erez Gurari
(74) *Attorney, Agent, or Firm* — Paratus Law Group, PLLC

(57) ABSTRACT

Disclosed is a multi-function block for a snow sliding apparatus for enabling sliding on a surface of snow. The multi-function block is provided between a deck, constituting part of the snow sliding apparatus, and a bottom surface of a binding or boot, and spaces the binding or boot apart from the deck. A plurality of first fastening holes is formed in the multi-function block. At least any one of the deck, the binding and the boot is fastened to the plurality of first fastening holes. The first fastening holes are formed through at least any one of outside surfaces of the multi-function block. The multi-function block is formed in a three-dimensional shape having at least one pair of parallel outside surfaces.

12 Claims, 11 Drawing Sheets

MULTI-FUNCTION BLOCK AND SNOW SLIDING APPARATUS COMPRISING SAME

CROSS REFERENCE TO PRIOR APPLICATION

This application is a National Stage Patent Application of PCT International Patent Application No. PCT/KR2014/000344 (filed on Jan. 13, 2014) under 35 U.S.C. §371, which claims priority to Korean Patent Application No. 10-2013-0003712 (filed on Jan. 13, 2013), which are all hereby incorporated by reference in their entirety.

BACKGROUND

The present invention relates generally to a snow sliding apparatus, and more particularly to a snow sliding apparatus that can slide along the surface of snow, can alter the height of a boot in various manners, and can protect its edges.

Sports using apparatuses that enable sliding along the surface of snow are represented by skiing and snowboarding. Skis refers to an apparatus that enables a user to wear them on his or her feet and to adjust a direction using skis and ski sticks, and a snowboard refers to an apparatus that enables a user to ride with his or her feet on a single deck.

Furthermore, recently, pieces of equipment that are used with apparatuses having a short length worn on both feet of users without requiring separate ski sticks, such as a skiboard, have been developed and used.

Of these pieces of equipment, equipment having relatively short lengths, such as a snowboard and a skiboard, enables various techniques, and thus have been recently attracting a lot of attention.

In the case of these sliding apparatuses, users have the sensation of speed and the sensation of manipulation differing depending on the height between boots and a deck during riding. In particular, in the state in which boots are somewhat spaced apart from the surface of snow, the sensation of speed is increased, and manipulation, such as rotating manipulation, etc., is facilitated.

However, inconvenience arises in that in order to space boots apart from the surface of snow, deformation is required to increase the height of a deck itself or increase the bottoms of boots, and also a problem arises in that once boots have been spaced apart from the surface of snow by a specific height, deformation required to decrease or increase the height is difficult to perform.

Furthermore, since these various types of snow sliding apparatuses require different types of boots, various problems arise when different types of boots are applied to snow sliding apparatuses. For example, when the width of boots is larger than that of a deck, the bottom surfaces of the boots of a snow sliding apparatus generate friction with the surface of snow, and thus a problem arises in that a user cannot easily ride using the snow sliding apparatus.

Meanwhile, various techniques can be implemented using the snow sliding apparatuses. Of these high-level techniques, there are techniques using obstacles. For example, there are various techniques, such as a technique of sliding along an obstacle at a height spaced apart from the surface of snow using the sliding apparatuses, etc.

However, a problem arises in that the snow sliding apparatuses are damaged when users slide along obstacles using the snow sliding apparatuses. More specifically, decks that generate friction with obstacles are worn by repeated riding. In particular, both side surfaces (edges) of the decks that actually generate fraction with obstacles are chiefly worn or damaged.

SUMMARY

Accordingly, the present invention is intended to overcome the above-described problems of the conventional art, and an object of the present invention is to provide a snow sliding apparatus that can vary a height from the surface of snow to a boot in various manners.

Another object of the present invention is to prevent the edges of a snow sliding apparatus from being easily worn even when a user rides along an obstacle.

Still another object of the present invention is to enable various types of boots to be applied and prevent friction between a boot and the surface of snow even when a boot having a width broader than that of a deck is applied.

According to an aspect of the present invention intended to accomplish the above-described objects, the present invention provides a multi-function block for a snow sliding apparatus for enabling sliding on a surface of snow, wherein the multi-function block is provided between a deck, constituting part of the snow sliding apparatus, and the bottom surface of a binding or boot, and spaces the binding or boot apart from the deck; a plurality of first fastening holes configured such that at least any one of the deck, the binding and the boot is fastened thereto is formed in the multi-function block; the first fastening holes are formed through at least any one of the outside surfaces of the multi-function block; and the multi-function block is formed in a three-dimensional shape having at least one pair of parallel outside surfaces.

Furthermore, the cross section of the multi-function block may be formed in the shape of a polygon, and the polygon that forms the cross section of the multi-function block may be formed to have a lateral width and a vertical height, which are different from each other, so that the distance between the deck and the binding or boot is variable based on the angle at which the multi-function block is combined between the deck and the binding or boot.

Second fastening holes that are open in left and right directions of the deck may be formed through left and right side surfaces of the multi-function block, respectively, and a plurality of weight reduction holes may be formed in the multi-function block, thereby reducing the weight of the multi-function block.

According to an aspect of the present invention, there is provided a snow sliding apparatus for enabling sliding on a surface of snow, including a plate-shaped deck configured to extend in a direction; a binding or boot coupled to the top of the deck; and one or more multi-function blocks combined between the deck and the binding or boot, and configured to space the deck and the binding or boot apart from each other; wherein each of the multi-function blocks is formed to have a polygonal cross section, the one or more multi-function blocks are disposed on the deck, and a plurality of first fastening holes is formed in each of the multi-function blocks.

Furthermore, the plurality of first fastening holes may be formed through at least any one of the outside surfaces of each of the multi-function blocks, and the multi-function blocks may be each formed in a three-dimensional shape so that the cross section of the multi-function block is formed in the shape of a polygon.

In this case, the polygon that forms the cross section of the multi-function block may be formed to have a lateral width and a vertical height, which are different from each other, so that the distance between the deck and the binding or boot is variable based on the angle at which the multi-function blocks are combined between the deck and the binding or boot.

Meanwhile, an auxiliary sliding part configured to protect the left and right edges of the deck may be combined with the left and right side surfaces of the multi-function blocks, and or assists sliding of the deck, second fastening holes may be formed through left and right side surfaces of each of the multi-function blocks, and the auxiliary sliding part may be fastened to the second fastening holes in the state of being in contact with or being spaced apart from them using fasteners.

Furthermore, a wear plate may be provided between the deck and the multi-function blocks and the binding or boot, and may prevent direct contact between a surface of snow and the boot.

Furthermore, the deck may be provided with rails protruding in the lengthwise direction of the deck, and a plurality of rail holes configured such that the multi-function blocks are fastened thereto may be formed in the protruding rails. The deck may be provided with the protruding rails that are at least two in number, and some of the multi-function blocks may be disposed across the protruding rails and one or more remaining multi-function blocks may be disposed in a direction parallel to the protruding rails.

Meanwhile, a damper spacer may be provided between the deck and the multi-function blocks or between the multi-function blocks and the binding or boot.

The following effects can be expected from the above-described multi-function block and snow sliding apparatus including the same according to the present invention.

In the present invention, the snow sliding apparatus is provided with the multi-function block, and thus a boot can be spaced apart from the surface of snow. In particular, the height of the boot can be altered based on the angle at which the multi-function block is combined, and thus a user can freely set his or her desired riding height, thereby achieving the effect of improving the manipulability of the snow sliding apparatus.

Furthermore, in the present invention, the height of a boot can be increased using the multi-function block having a volume and a weight smaller than those of a fastening block or rubber damper having a size corresponding to the area of a deck, and thus the overall weight of the snow sliding apparatus can be reduced, thereby achieving the effect of improving riding performance.

Additionally, in the present invention, the snow sliding apparatus is provided with the wear plate and thus prevents direct friction between the bottom surface of a boot and the surface of snow, thereby achieving the effect of improving the compatibility of the snow sliding apparatus because various boots or bindings can be applied to the deck regardless of the sizes or types of boots or bindings, and also achieving the effect of preventing a boot from being worn during riding.

Furthermore, in the present invention, the auxiliary riding part is provided and protects the edges of the deck, and thus the edges are prevented from being worn or damaged by an obstacle even when a user rides along various obstacles, such as guardrails or rails, using the deck, thereby achieving the effect of improving the durability of the deck.

Figure 8:
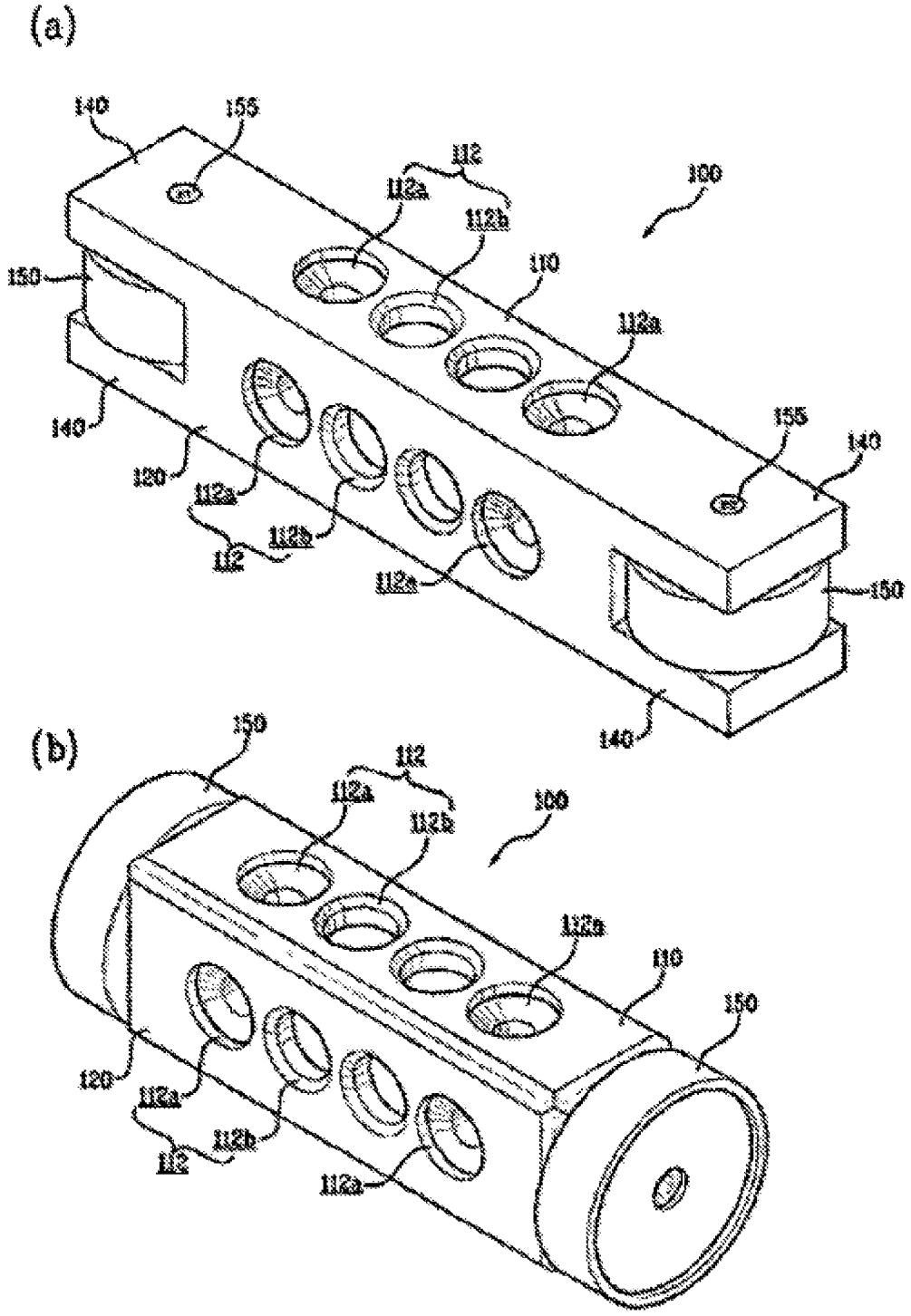
Figure 9:
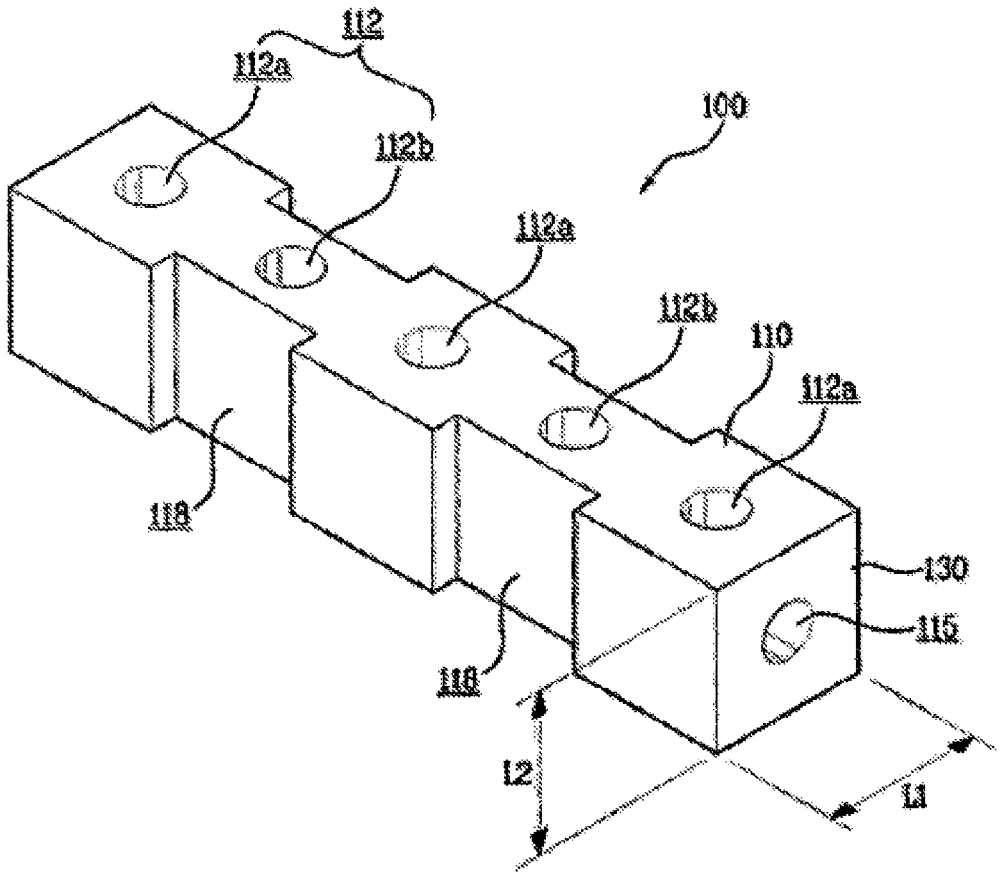
Figure 10:
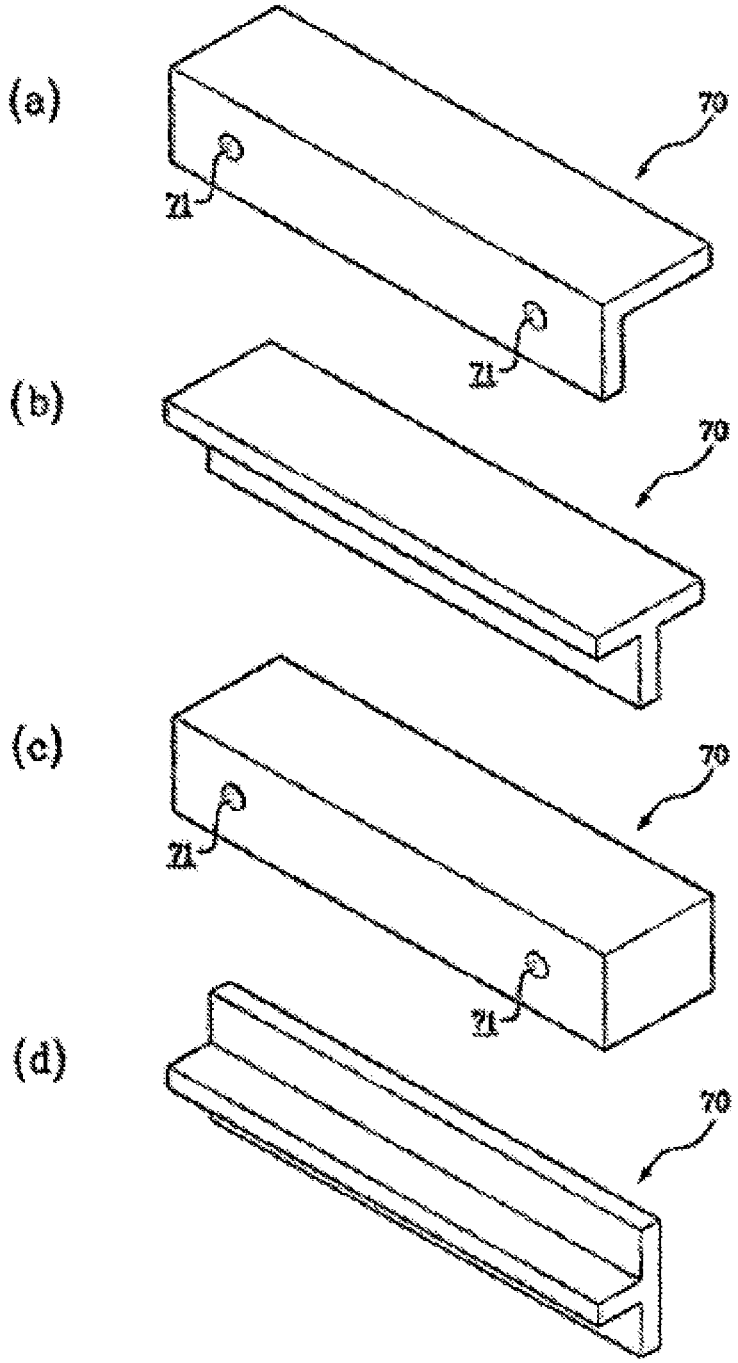
Figure 11:
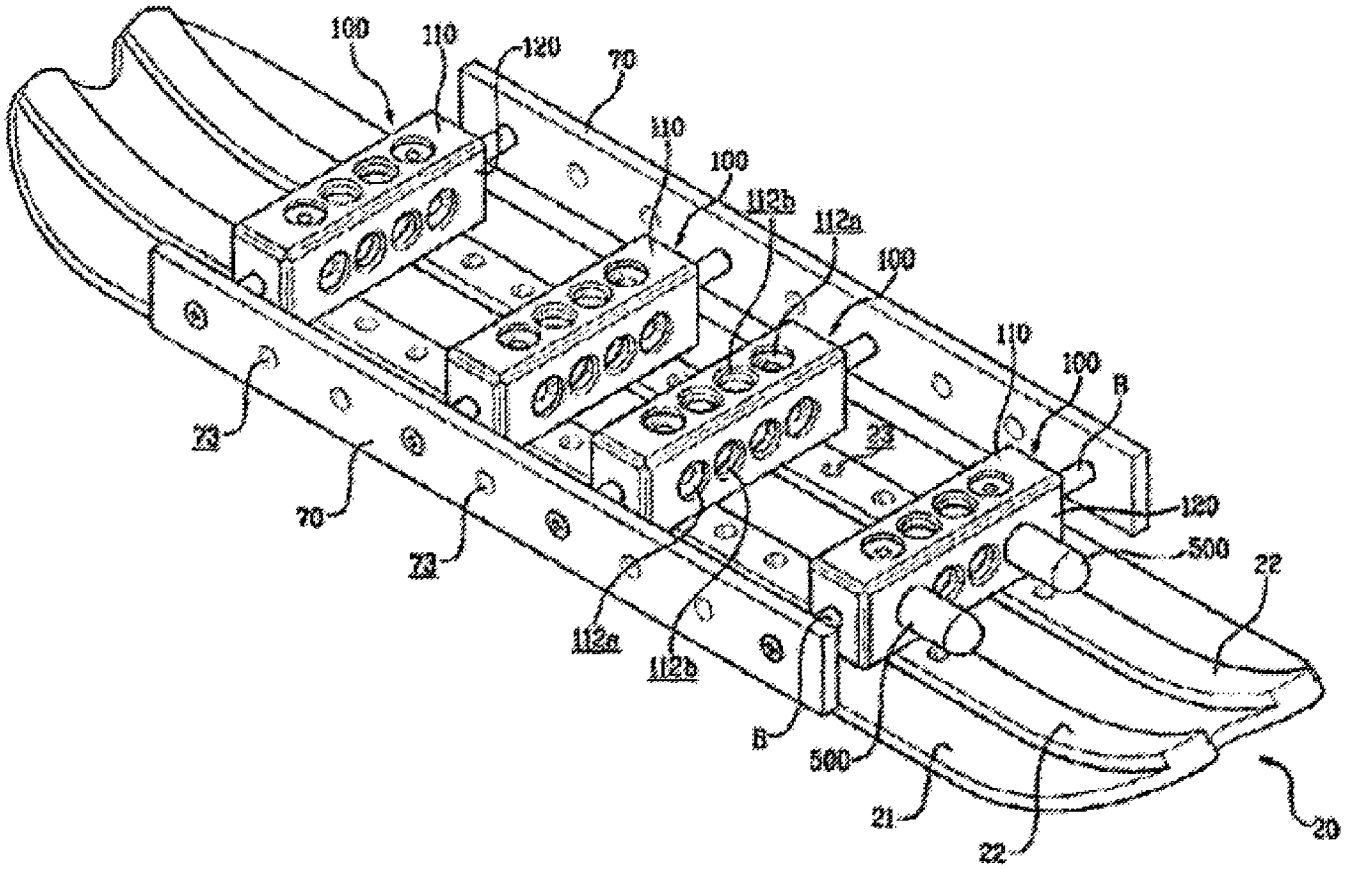

(a) and (b) of FIG. 8 are perspective views showing the configurations of a third embodiment and a fourth embodiment of a multi-function block according to the present invention;

FIG. 9 is a perspective view showing the configuration of a fifth embodiment of a multi-function block according to the present invention;

(a) to (d) of FIG. 10 are exemplary diagrams showing the configurations of various embodiments of an auxiliary sliding part that constitutes part of an embodiment of the present invention; and FIG. 11 is a perspective view showing the configuration of another embodiment of a snow sliding apparatus provided with multi-function blocks according to the present invention.

DETAILED DESCRIPTION

The present invention provides a multi-function block for a snow sliding apparatus for enabling sliding on a surface of snow, wherein the multi-function block is provided between a deck, constituting part of the snow sliding apparatus, and the bottom surface of a binding or boot, and spaces the binding or boot apart from the deck; a plurality of first fastening holes configured such that at least any one of the deck, the binding and the boot is fastened thereto is formed in the multi-function block; the first fastening holes are formed through at least any one of the outside surfaces of the multi-function block; and the multi-function block is formed in a three-dimensional shape having at least one pair of parallel outside surfaces.

In this case, the cross section of the multi-function block may be formed in the shape of a polygon, and the polygon that forms the cross section of the multi-function block may be formed to have a lateral width and a vertical height, which are different from each other, so that the distance between the deck and the binding or boot is variable based on the angle at which the multi-function block is combined between the deck and the binding or boot. Second fastening holes that are open in the left and right directions of the deck may be formed through left and right side surfaces of the multi-function block, respectively, and a plurality of weight reduction holes may be formed in the multi-function block, thereby reducing the weight of the multi-function block.

Specific embodiments of a multi-function block and a snow sliding apparatus including the same according to the present invention, as described above, are described in detail below with reference to the accompanying diagrams.

Figure 1:
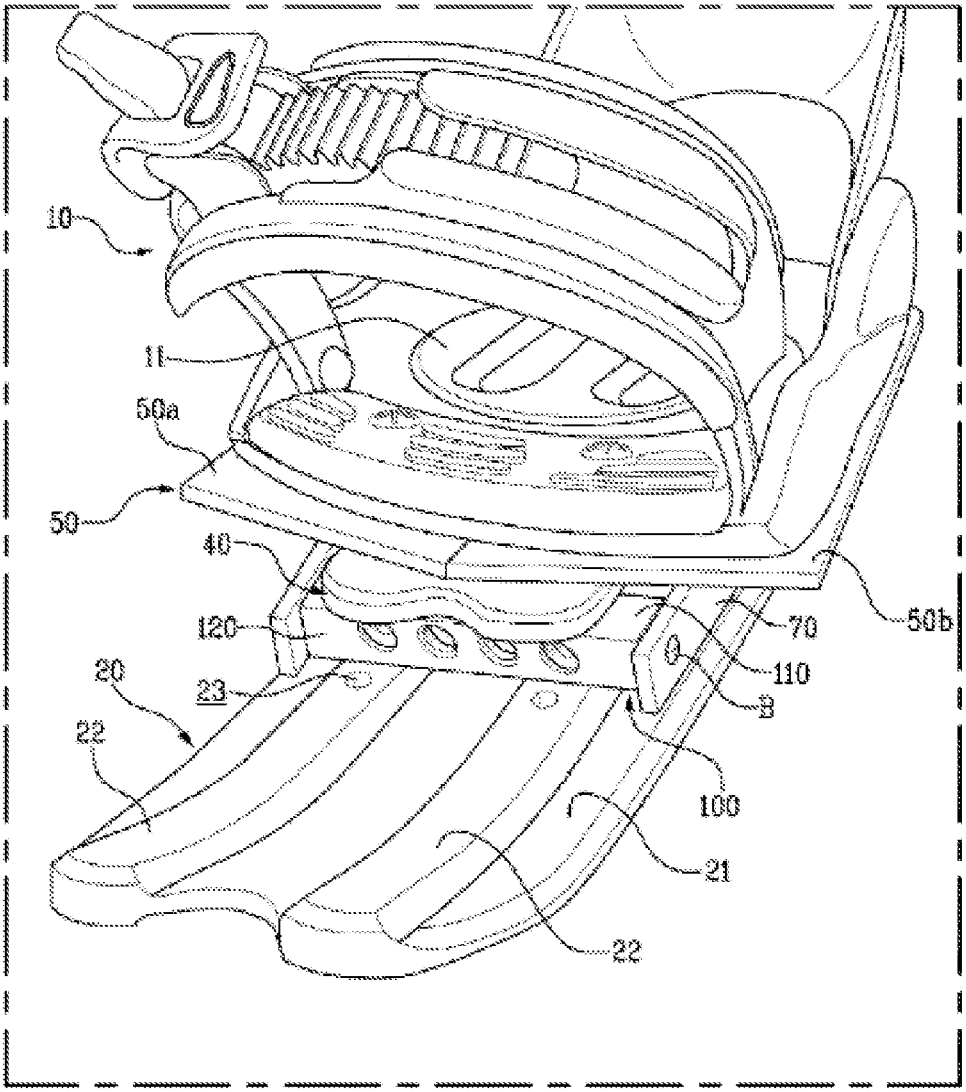
FIG. 1 is a perspective view showing the configuration of a preferred embodiment of a snow sliding apparatus according to the present invention.
Figure 2:
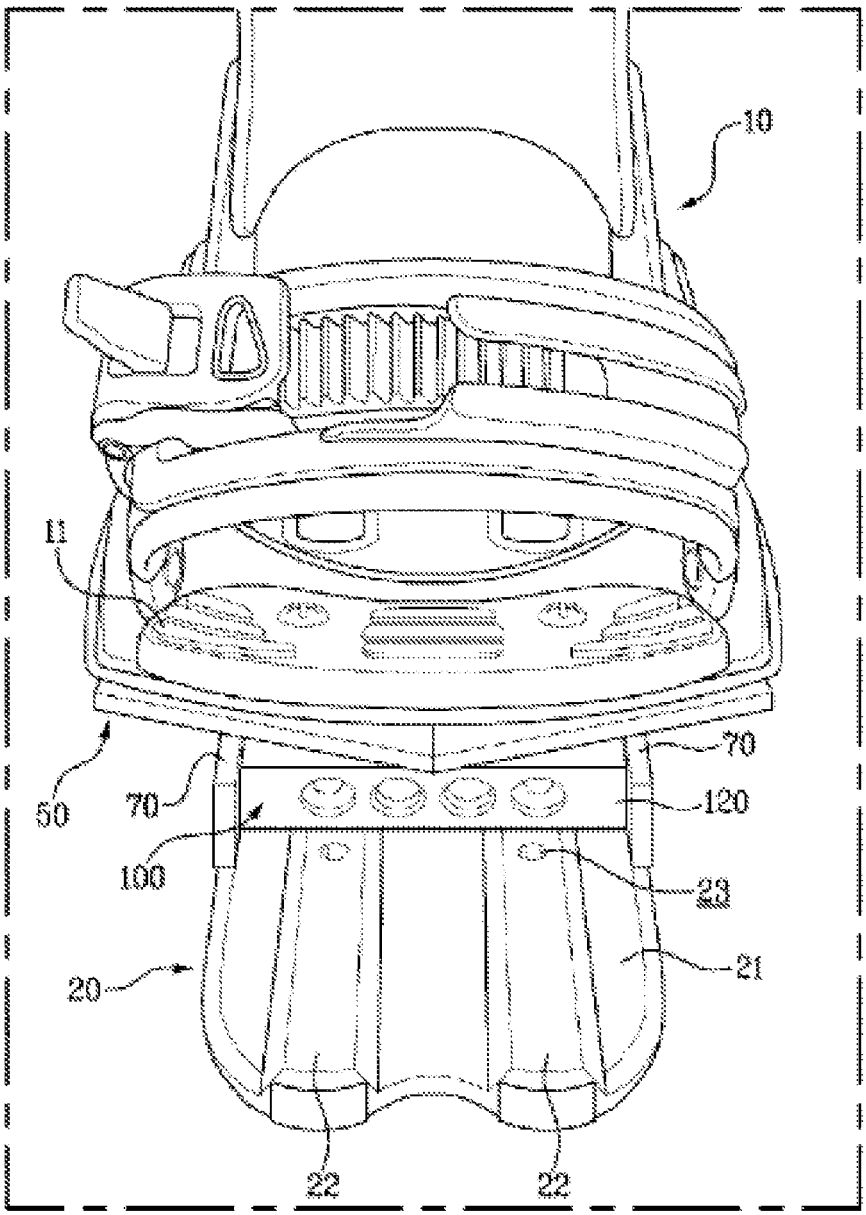
FIG. 2 is a perspective view showing the configuration of a snow sliding apparatus according to the present invention.

In FIG. 1, the configuration of a preferred embodiment of a snow sliding apparatus according to the present invention is shown as a perspective view, and, in FIG. 2, the configuration of a snow sliding apparatus according to the present invention is shown as a perspective view.

As shown in the diagram, the snow sliding apparatus according to the present invention is intended to enable a user wearing it to easily slide along the surface of snow and also to deal with various types and sizes of boots (or bindings 10) and protect the edges of a deck 20. In this case, the edges of the deck 20 refer to both side ends of the deck 20.

For ease of description, the binding 10 is described first. The binding 10 is combined with the top of the deck 20, and functions to fasten a boot (not shown). As shown in FIG. 1, the bottom 11 of the binding 10 is fastened onto the deck 20 by bolts. To deal with boots, various sizes and types of bindings 10 are present. In the embodiment of the present invention, the binding 10 having a width broader than that of the deck 20 is presented by way of example. Although the binding 10 may be omitted and a boot may be directly combined with the deck 20, a snow sliding apparatus including the binding 10 is described below as an example.

In the snow sliding apparatus according to the present invention, a plate-shaped body 21 forms the appearance and skeleton of the snow sliding apparatus, as shown in FIG. 1. The body 21 may be made of various materials, such as wood, metal, alloy, synthetic resin, composite material, etc., and may be fabricated in a shape which extends parallel in a direction or whose center portion is bent upward.

It is preferred that the body 21 be formed to extend lengthily in a direction and have a smooth outside surface so that a user wearing it can slide along the surface of snow using the bottom thereof.

Protruding rails 22 are provided on the top surface of the body 21. More precisely, the protruding rails 22 are formed to protrude from the top surface of the body 21. Rail holes 23 that enable combination with the binding 10 or one or more multi-function blocks 100 to be described later are formed on the top surfaces of the protruding rails 22. A plurality of rail holes 23 is formed along each of the protruding rails 22, and enables combination with the binding 10 or multi-function blocks 100 at various locations.

In this case, the protruding rails 22 are formed to protrude from the body 21, and thus enable a user to slide in the state of being spaced apart at a location above the surface of the ground. This allows the center of gravity of a user to be raised above the support of the ground, and enables various techniques due to the free acquisition of rotating force, etc.

Furthermore, the plurality of rail holes 23 is formed along each of the protruding rails 22 at regular intervals, and thus a user can adjust a location at which the binding 10 and a boot is worn. The protruding rails 22 themselves function as a type of ribs intended to enhance the strength of the body 21, thereby improving durability regarding the overall strength and bending of the snow sliding apparatus.

A fastening frame 40 is combined with the deck 20. The fastening frame 40 is provided between the multi-function blocks 100 to be described and the binding 10, and functions as a medium that couple the multi-function blocks 100 with the binding 10. As shown in FIG. 1, the fastening frame 40 is provided in an approximately thin plate shape. It will be apparent that since the snow sliding apparatus of the present invention is provided with the multi-function blocks 100, the fastening frame 40 may be omitted according to the preference and need of a user.

A plurality of binding holes (not shown) is formed in the fastening frame 40. The intervals between the plurality of binding holes are formed to have various widths and distances, and thus can deal with more various sizes and types of bindings 10.

A wear plate 50 is provided on the bottom surface of the binding 10. The wear plate 50 is provided in a thin plate shape, and functions to protect the bottom surface of the binding 10 or a boot. That is, the wear plate 50 comes into contact with the bottom surface of the binding 10, and prevents the surface of snow from generating direct friction with the binding 10 during riding. For this purpose, it is preferred that the wear plate 50 have a width equal to or broader than that of the bottom surface of the binding 10.

The wear plate 50 may be made of synthetic resin, such as reinforced plastic, or metal. The outside surface of the wear plate 50 may be coated with a coating material in order to improve wear resistance.

In this case, the wear plate 50 may be composed of a plurality of segments. The plurality of segments of the wear plate 50 are fastened to the fastening frame 40 in the state of being spaced apart from each other, and thus the intervals between the plurality of segments of the wear plate 50 may be adjusted.

For example, although the wear plate 50 may be formed as a single body, the wear plate 50 may be composed of a first plate 50*a* and a second plate 50*b* that extend along the lengthwise direction of the deck 20, as shown in FIG. 1.

The multi-function blocks 100 are provided between the deck and the binding 10. The multi-function blocks 100 are intended to increase the distance between the deck 20 and the binding 10 and thus improve running performance and increase the sensation of speed during sliding. The multi-function blocks 100 are formed in three-dimensional shapes that extend lengthily approximately in a direction, as shown in FIGS. 3 to 7.

A plurality of multi-function blocks 100 may be provided between the deck 20 and the binding 10. In the embodiment of the present invention, the multi-function blocks 100 are combined below the wear plate 50.

Each of the multi-function blocks 100 is formed in a three-dimensional shape having at least one pair of parallel outside surfaces. In this case, one of the at least one pair of parallel outside surfaces (in the embodiment of the present invention, the top surface of the multi-function block 100) comes into contact with the fastening frame 40, the binding 10 or the wear plate 50, and the other surface (in the embodiment of the present invention, the bottom surface of the multi-function block 100) comes into contact with the deck 20.

Figure 6:
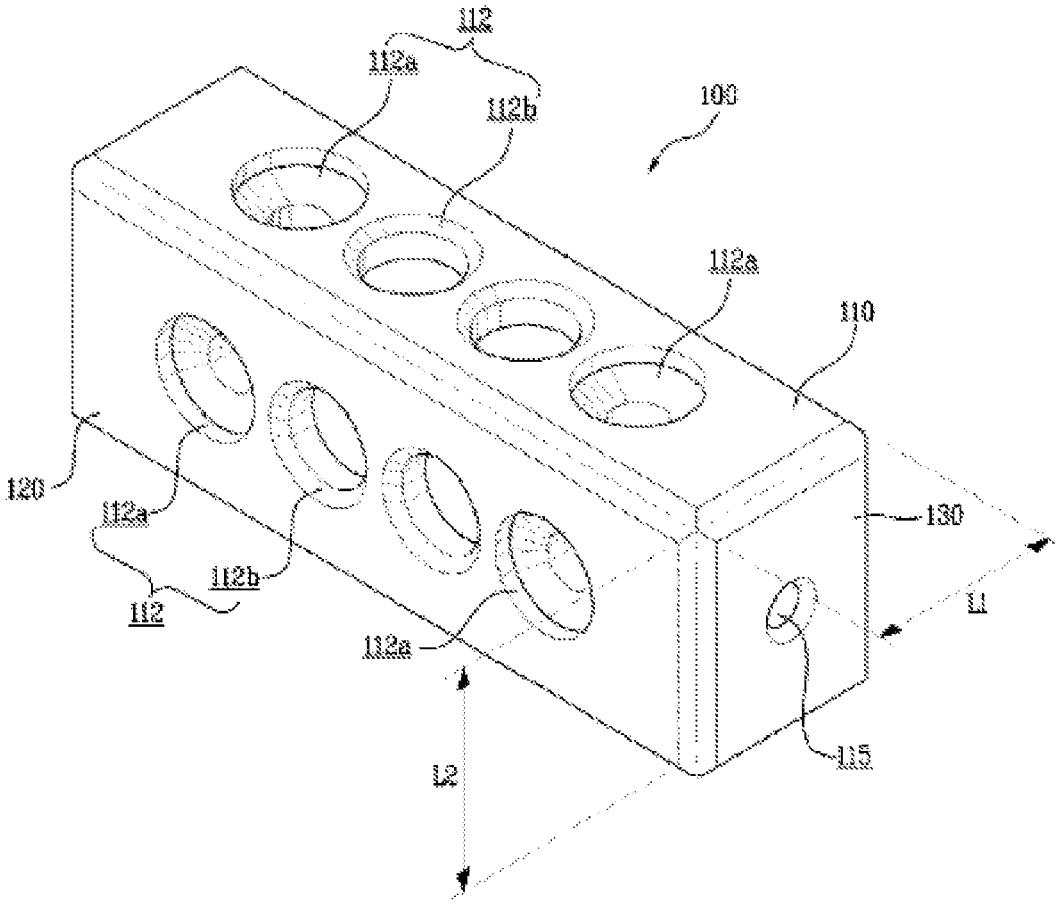
FIG. 6 is a perspective view showing the configuration of a preferred embodiment of a multi-function block according to the present invention.

The cross section of at least part of the multi-function block 100 may be formed in a polygonal or circular shape. In the embodiment of the present invention, the cross section of at least part of the multi-function block 100 has an approximately rectangular cross section, as shown in FIG. 6. In this case, a polygon that forms the cross section of the multi-function block 100 is formed to have a lateral width L1 and a vertical height L2 that are different from each other, and thus the distance between the deck 20 and the binding 10 or boot may be variable depending on an angle at which the multi-function block 100 is combined between the deck 20 and the binding 10.

Figure 7:
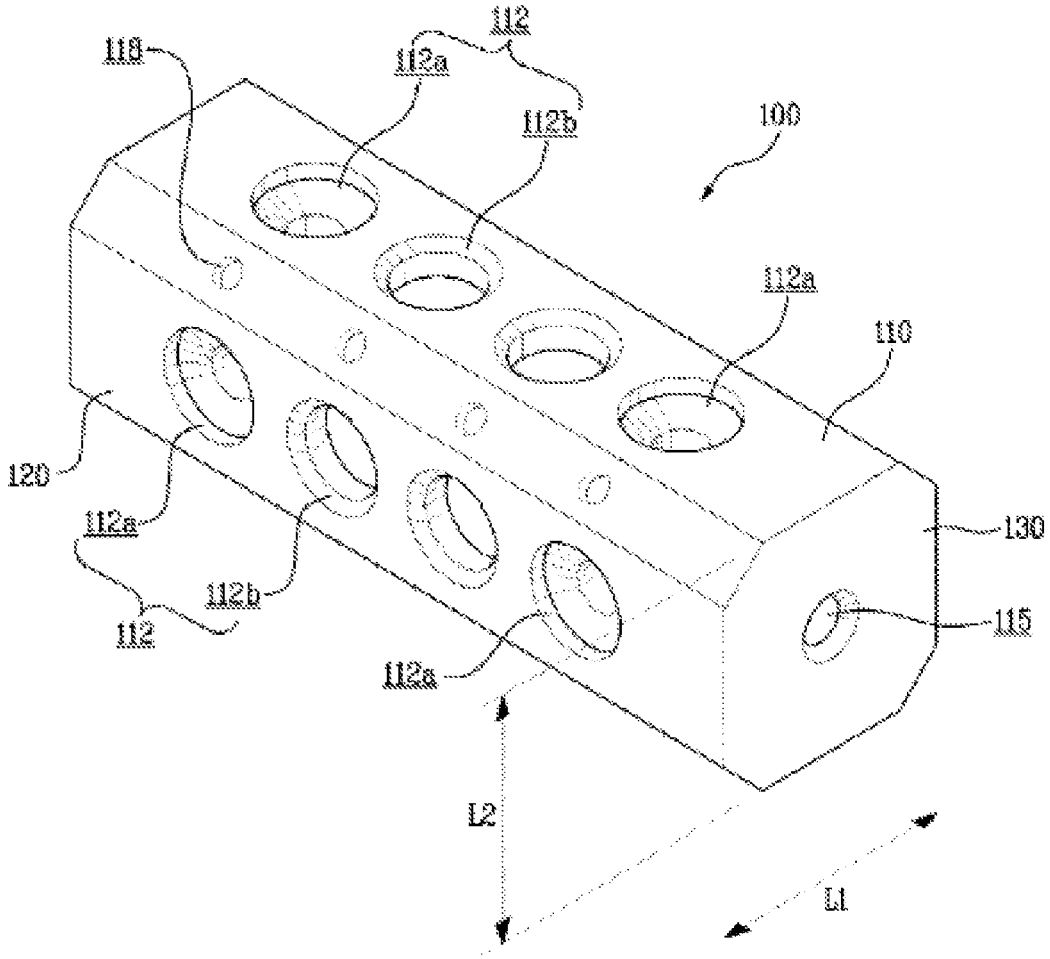
FIG. 7 is a perspective view showing the configuration of a second embodiment of a multi-function block according to the present invention.

That is, when the multi-function block 100 is combined in the direction shown in FIG. 6, the height between the deck 20 and the binding 10 becomes L2. In contrast, when the multi-function block 100 is rotated by 90 degrees from the direction shown in FIG. 6, a side surface 120 of the multi-function block 100 comes downward into contact with the deck 20, the height between the deck 20 and the binding 10 becomes L1. It will be apparent that the multi-function block 100 may have an octagonal cross section and the corners of the multi-function block 100 are rounded, as shown in FIG. 7.

Meanwhile, as shown in FIG. 9, the area and shape of the cross section of the multi-function block 100 may be variable along the lengthwise direction thereof. Accordingly, recesses 118 may be formed in the multi-function block 100. Furthermore, these recess 118 perform the function of reducing the overall volume and weight of the multi-function block 100.

In this case, first fastening holes 112 configured to perform combination with at least any one of the deck 20, the binding 10 and the boot are formed in the multi-function block 100. A plurality of first fastening holes 112 is formed through at least any one of the outside surfaces of the multi-function block 100. In the embodiment of the present invention, the first fastening holes 112 are formed through the top surface 110 and front surface 120 of the multi-function block 100.

In this case, some 112*b* of the first fastening holes 112 may be weight reduction holes configured to reduce the weight of the multi-function block 100.

Figure 3:
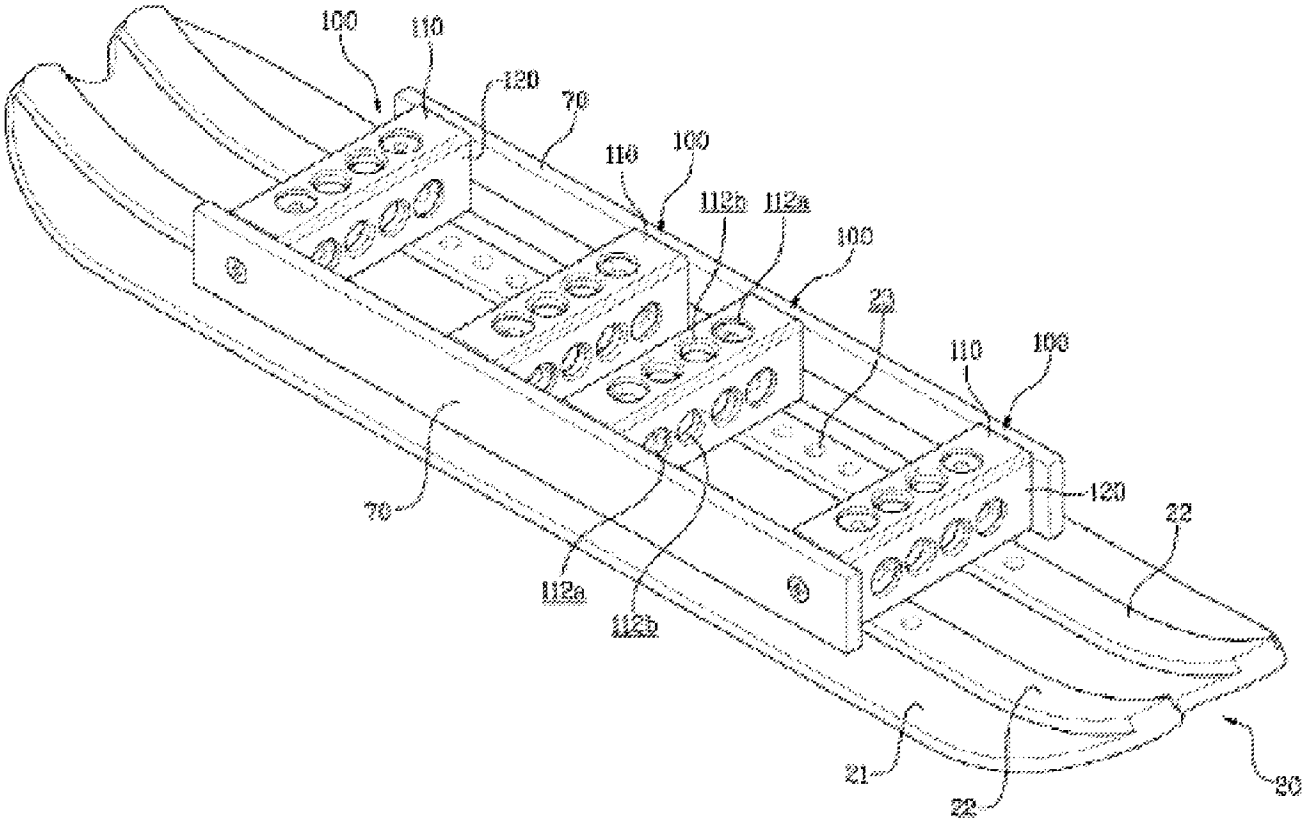
FIG. 3 is a perspective view showing a configuration with a binding and a boot that constitute part of an embodiment of the present invention eliminated therefrom.

In the embodiment of the present invention, the multi-function block 100 is formed in an approximate bar shape that extends lengthily in a direction, and is disposed across the two protruding rails 22 of the deck 20. Furthermore, as shown in FIG. 3, one of the first fastening holes 112 of the multi-function block 100 corresponds to a rail hole 23 of any one of the protruding rails 22, and another first fastening hole 112 corresponds to a rail hole 23 of the other protruding rail 22.

The plurality of multi-function blocks 100 is combined with the top of the deck 20, and thus the fastening frame 40 or binding 10 can be stably supported on the top of the multi-function blocks 100.

It will be apparent that the plurality of multi-function blocks 100 is combined at various locations on the protruding rails 22 because the number of rail holes 23 formed in the protruding rails 22 is large.

Figure 4:
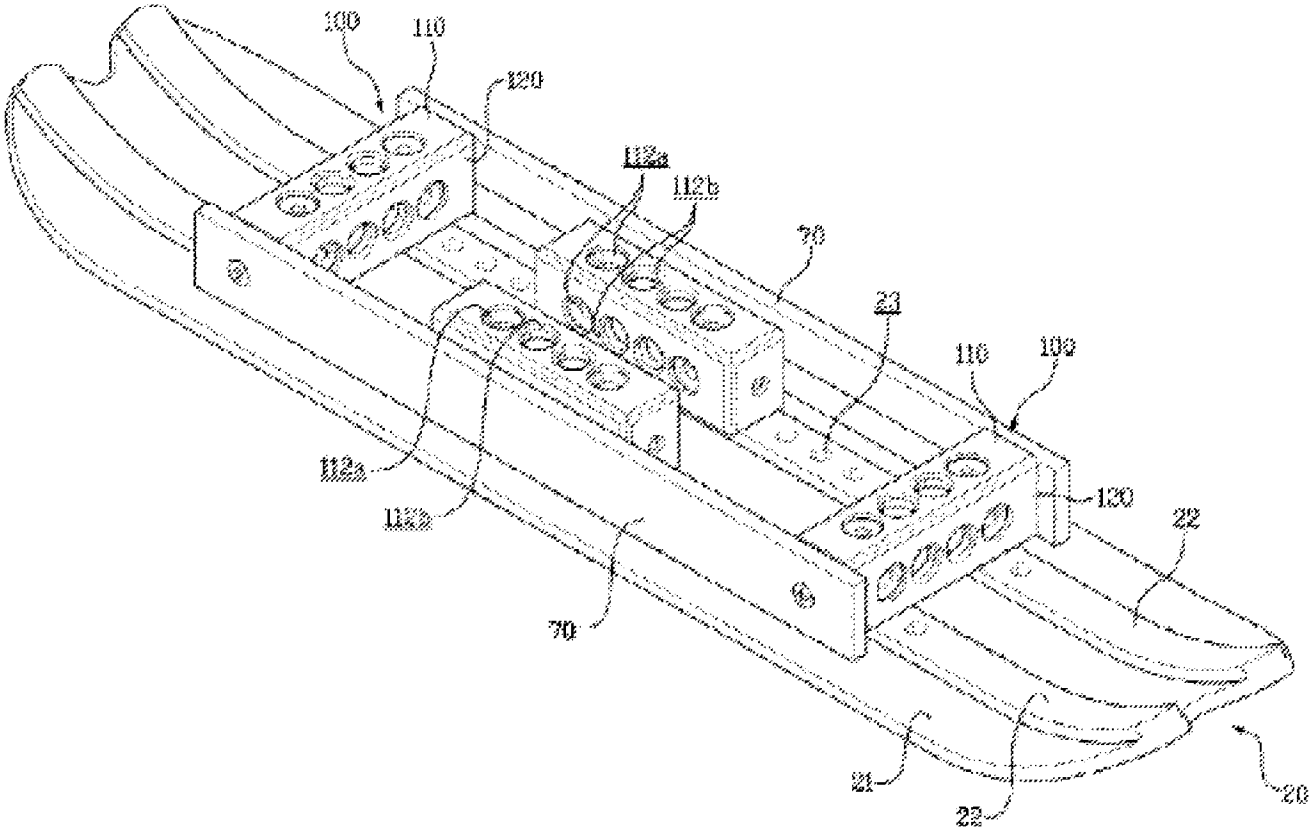
FIG. 4 is a perspective view showing a configuration with multi-function blocks that constitute part of an embodiment of the present invention combined at an angle different from that in the embodiment of FIG. 3.

Furthermore, as shown in FIG. 4, some of the multi-function blocks 100 may be combined in a direction parallel to the lengthwise direction of the protruding rails 22. This may be selectively adopted depending on the shape of the fastening frame 40 or binding 10.

Meanwhile, second fastening holes 115 that are open in the left and right directions of the deck 20 are formed through the left and right side surfaces of the multi-function block 100. The second fastening holes 115 are used for combination with an auxiliary sliding part 70, which will be described below.

The auxiliary sliding part 70 is combined with the multi-function block 100. The auxiliary sliding part 70 is provided at locations corresponding to the left and right sides of the deck 20. When a user rides along an obstacle or the like using the snow sliding apparatus, the auxiliary sliding part 70 functions to prevent the deck 20 from being worn by generating friction with the obstacle in place of the edges of the deck 20 and to assist the sliding of the deck 20. Furthermore, the auxiliary sliding part 70 is replaceably combined with the multi-function block 100, and may be used based on the concept of a consumable product whose replacement is expected by a user. Although the auxiliary sliding part 70 is made of synthetic resin material in the embodiment of the present invention, it may be made of metal or various materials that are smooth and thus can reduce friction.

In this case, it is preferred that the auxiliary sliding part 70 protrudes to locations corresponding to the edges of the deck 20, as shown in FIG. 1. The reason for this is that the auxiliary sliding part 70 generates friction with an obstacle instead of the edges. For example, when the obstacle has a rod shape, the obstacle may be inserted between the top surface of the deck 20 and the auxiliary sliding part 70 or be inserted into an approximately inverted and reversed "L"-shaped depression formed by the bottom surface of the wear plate 50 and the auxiliary sliding part 70, and then may generate friction.

Figure 5:
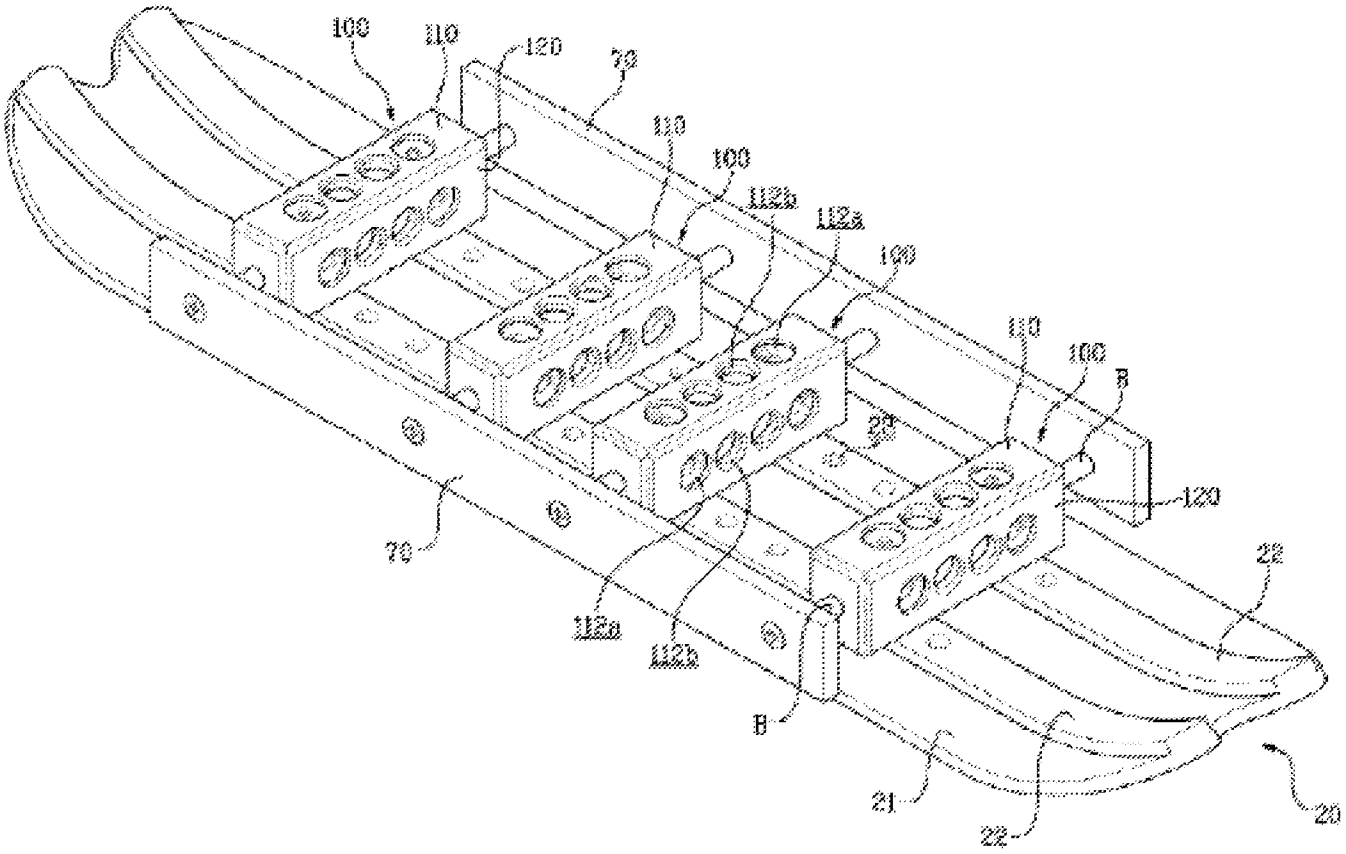
FIG. 5 is a perspective view showing a configuration with an auxiliary sliding part spaced apart from multi-function blocks that constitute part of an embodiment of the present invention.

Meanwhile, as shown in FIG. 5, the auxiliary sliding part 70 may be combined in the state of being spaced from the multi-function block 100. This is enabled by fasteners B that couple the auxiliary sliding part 70 with the multi-function block 100. Accordingly, when the deck 20 is replaced and the width of the deck 20 is altered, the multi-function block 100 and edge protectors may be applied without change.

Furthermore, as shown in FIG. 10, the auxiliary sliding part 70 may be formed in a frame shape that extends in the lengthwise direction of the deck 20, and may have various shapes. For example, as shown in (a) of FIG. 10, the auxiliary sliding part 70 may be configured to increase an area in contact with an obstacle in such a way as to include a portion parallel to the top surface of the deck 20 and a portion perpendicular to the top surface of the deck 20.

Furthermore, as shown in FIG. 11, coupling holes 73 or assembly parts (not shown) are formed in the auxiliary sliding part 70, and a separate additional frame (not shown), an additional plate (not shown), or an accessory may be combined with the auxiliary sliding part 70.

Furthermore, as shown in FIG. 8, both sides of the multi-function block 100 or the auxiliary sliding part 70 combined with the multi-function block 100 may be formed in rolling wheel structures 150. That is, the rolling wheel structures 150 reduce friction in the case of contact with an obstacle, and enable the snow sliding apparatus to slide more smoothly. These rolling wheel structures 150 may have an axis of rotation extending in a direction parallel to the lengthwise direction of the multi-function block or axes of rotation perpendicular to the lengthwise direction of the multi-function block. The rolling wheel structures 150 may be formed in wheel or ball shapes. Although wheel-shaped rolling wheel structures 150 are shown and combined with the multi-function blocks 100 in all the embodiments shown in FIG. 8, the rolling wheel structures 150 may be provided in the auxiliary sliding part 70.

Although not shown in the drawings, one or more damper spacers (not shown) may be provided at various locations, such as a location between the multi-function block 100 and the deck 20, a location on the fastening frame 40, etc. The damper spacers enable a user to set the desired height of the binding 10 by spacing the binding 10 and the deck 20 apart from each other. A plurality of damper spacers may be stacked on top of another. Furthermore, it is preferred that the damper spacers be made of elastic material, such as silicon or rubber, so that they can perform a damping function during riding.

Furthermore, as shown in FIG. 11, a lamp 500 may be provided in the first fastening holes 112*a*, second fastening holes 115 or weight reduction holes 112*b* of the multi-function block 100. At least any one of an accessory (not shown) and an assembly tool (not shown) may be combined, apart from the lamp 500.

The operation of the snow sliding apparatus according to the present invention is described in detail with reference to the drawings.

In the process of assembling the snow sliding apparatus according to the present invention, first, a user stacks the damper spacer and the multi-function blocks 100 on the top surface of the deck 20. In this case, the damper spacer may be omitted depending on the user-desired height of the binding 10 or a plurality of damper spacers may be stacked on top of another. In this case, the damper spacer and the multi-function blocks 100 must be stacked to be consistent with the rail holes 23 formed in the protruding rails 22 of the deck 20.

In this case, the angle and direction at and in which the multi-function blocks 100 are combined may be set in various manners. For example, when the multi-function blocks 100 are combined in the state of FIG. 6, the height thereof becomes L2. When the multi-function blocks 100 are rotated by 90, L1 becomes the height thereof. Furthermore, as shown in FIG. 3 or 4, the direction in which the multi-function blocks 100 are disposed on the deck 20 may be also variable, and thus the direction in which the multi-function blocks 100 are combined may be adjusted according to the selection of a user.

Thereafter, the fastening frame 40 is disposed on the top of the multi-function block 100. Since the combination between the deck 20 and the binding 10 is performed through the medium of the multi-function block 100, the fastening frame 40 may be omitted.

In this state, the wear plate 50 is disposed on the top of the fastening frame 40. The wear plate 50 may be composed of two parts, as shown in FIG. 1, in which case the width of the wear plate 50 may be adjusted by spacing the two parts of the wear plate 50 apart from each other.

Finally, after the user has disposing the binding 10 on the top surface of the wear plate 50, the binding 10 is fastened to the wear plate 50 and the fastening frame 40, or may be directly fastened to the deck 20 via the wear plate 50, the fastening frame 40, the multi-function block 100 and the damper spacer, using fasteners, such as bolts.

In this case, the user may additionally combine the auxiliary sliding part 70 with both side surfaces of the multi-function block 100. That is, when the user rides along an obstacle using the snow sliding apparatus, the auxiliary sliding part 70 may be additionally attached in order to protect the edges.

The auxiliary sliding part 70 is provided at a location corresponding to a location between the wear plate 50 and the deck 20, as shown in FIG. 1. Furthermore, the auxiliary sliding part 70 comes into contact with the side surfaces of the multi-function blocks 100, or may be combined in the state of being spaced apart from the side surfaces of the multi-function blocks 100, as shown in FIG. 5.

Once the assembly of the snow sliding apparatus according to the present invention has been completed as described above, the wear plate 50 prevents direct friction between the bottom surface of a boot and the surface of snow. Furthermore, since the auxiliary sliding part 70 is provided and protects the edges of the deck 20, the edges are protected from being worn or damaged by various obstacles even when the user rides along various obstacles, such as guardrails or rails, using the deck 20.

Furthermore, the user may omit the fastening frame 40, and may perform combination between the binding 10 and the deck 20 through the medium of only the multi-function blocks 100. The user may space the surface of snow and a boot apart from each other using multi-function block 100. In particular, the height between the surface of snow and a boot can be altered based on the angle at which the multi-function blocks 100 are combined, and thus sliding suitable for the reference of the user can be selected.

The rights of the present invention are not limited to the above-described embodiments, but are defined based on the descriptions of the claims. It will be apparent to those having common knowledge in the field of the present invention that various modifications and alterations can be made within the range of rights described in the claims.

For example, although examples in which the plurality of rail holes 23 are formed along the protruding rails 22 at regular intervals and the multi-function blocks 100 are fastened to the rail holes 23 have been described in the embodiments, the multi-function blocks 100 may be applied to a general deck in which the protruding rails 22 and the rail holes 23 have not been formed. In this case, the multi-function blocks 100 may be fastened to the deck using the fastening frame 40.

The present invention relates to a snow sliding apparatus that enables sliding along the surface of snow, in which a user can freely set his or her desired riding height, thereby improving the manipulability of the snow sliding apparatus.

What is claimed is:

1. A snow sliding apparatus for enabling sliding on a surface of snow, comprising:

a plate-shaped deck configured to extend in a direction;

a binding or boot coupled to a top of the deck; and one or more multi-function blocks combined between the deck and the binding or boot, and configured to space the deck and the binding or boot apart from each other;

wherein each of the multi-function blocks is formed to have a polygonal cross section, the one or more multi-function blocks are disposed on the deck, and a plurality of first fastening holes is formed in each of the multi-function blocks, and wherein the deck is provided with rails protruding in a lengthwise direction of the deck, and a plurality of rail holes configured such that the multi-function blocks are fastened thereto is formed in the protruding rails.

2. The snow sliding apparatus of claim 1, wherein the plurality of first fastening holes is formed through at least any one of outside surfaces of each of the multi-function blocks, and the multi-function blocks are each formed in a three-dimensional shape so that a cross section of at least part of the multi-function block has a polygonal or circular shape.

3. The snow sliding apparatus of claim 2, wherein a polygon that forms the cross section of the multi-function block is formed to have a lateral width and a vertical height, which are different from each other, so that a distance between the deck and the binding or boot is variable based on an angle at which the multi-function blocks are each combined between the deck and the binding or boot.

4. The snow sliding apparatus of claim 1, wherein an auxiliary sliding part is detachably combined with left and right side surfaces of the multi-function blocks, and protects left and right edges of the deck or assists sliding of the deck.

5. The snow sliding apparatus of claim 4, wherein second fastening holes are formed through left and right side surfaces of each of the multi-function blocks, and the auxiliary sliding part is fastened to the second fastening holes in a state of being in contact with or being spaced apart from them using fasteners.

6. The snow sliding apparatus of claim 5, wherein the auxiliary sliding part is formed in a frame shape extending in a lengthwise direction of the deck, and the auxiliary sliding part is provided with a coupling hole or assembly part so that a separate additional frame or additional plate can be combined with the auxiliary sliding part.

7. The snow sliding apparatus of claim 6, wherein the auxiliary sliding part is formed in an inverted and reversed "L" shape, sideways "U" shape or sideways "T" shape.

8. The snow sliding apparatus of claim 5, wherein the auxiliary sliding part has rolling wheel structures, the rolling wheel structures have an axis of rotation extending in a direction parallel to the lengthwise direction of the multi-function blocks or an axis of rotation extending in a direction perpendicular to a lengthwise direction of the multi-function blocks, and the rolling wheel structures are formed in wheel or ball shapes.

9. The snow sliding apparatus of claim 5, wherein a wear plate is provided between the deck and the multi-function blocks and the binding or boot, and prevents direct contact between a surface of snow and the boot.

10. The snow sliding apparatus of claim 1, wherein the deck is provided with the protruding rails that are at least two in number, and some of the multi-function blocks are disposed across the protruding rails and one or more remaining multi-function blocks are disposed in a direction parallel to the protruding rails.

11. The snow sliding apparatus of claim 10, wherein a damper spacer is provided between the deck and the multi-function blocks or between the multi-function blocks and the binding or boot.

12. The snow sliding apparatus of claim 11, wherein at least any one of a lamp, an accessory and an assembly tool is fastened to at least any one of the first fastening holes, second fastening holes or weight reduction holes of the multi-function blocks.

* * * * *